US011278121B1

(12) United States Patent
Tsai

(10) Patent No.: US 11,278,121 B1
(45) Date of Patent: Mar. 22, 2022

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 17/029,079

(22) Filed: Sep. 23, 2020

(51) Int. Cl.
*A47C 4/28* (2006.01)
*A47C 4/20* (2006.01)
*A47C 11/00* (2006.01)

(52) U.S. Cl.
CPC ..... *A47C 4/286* (2013.01); *A47C 4/20* (2013.01); *A47C 11/00* (2013.01); *A47C 11/005* (2013.01)

(58) Field of Classification Search
CPC ..... A47C 4/286; A47C 4/20; A47C 11/00; A47C 11/005
See application file for complete search history.

(56) References Cited

U.S. PATENT DOCUMENTS 1,738,473 A * 12/1929 Green ..... A47C 4/283 297/45
1,858,254 A * 5/1932 Uline ..... A47C 4/38 297/36
5,570,928 A * 11/1996 Staunton ..... A47C 11/005 297/232
7,648,196 B2 * 1/2010 Degelman ..... A47C 7/66 297/45
9,775,438 B1 * 10/2017 Schulenberg ..... A47C 7/624
10,631,648 B1 * 4/2020 Tsai ..... A47C 4/286
10,758,048 B1 * 9/2020 Tsai ..... A47C 3/00
2015/0359339 A1 * 12/2015 Choi ..... A47C 4/286 297/35
2015/0359344 A1 * 12/2015 Choi ..... A47C 7/62 248/313
2017/0181547 A1 * 6/2017 Yang ..... A47C 4/30
2020/0154891 A1 * 5/2020 Frankel ..... A47C 4/283
2020/0154897 A1 * 5/2020 Wang ..... A47C 11/005
2020/0275771 A1 * 9/2020 Zhu ..... A47C 7/70
2020/0323346 A1 * 10/2020 Chen ..... A47C 4/30

FOREIGN PATENT DOCUMENTS

CN 210185056 U * 3/2020
JP 2003174948 A * 6/2003 ..... A47C 4/283

* cited by examiner

*Primary Examiner* — Robert Canfield

(57) ABSTRACT

A folding chair includes a right seat receiver, right front and rear legs, a right armrest, a right armrest post, a right leg connecting member, a right backrest support, first and second right front support, and first and second right rear supports; a left seat receiver, left front and rear legs, a left armrest, a left armrest post, a left leg connecting member, a left backrest support, first and second left front support, and first and second left rear supports; a middle seat receiver, middle front and rear legs, a middle seat receiver post, a middle leg connecting member, a middle backrest support; a seat; and a backrest. These components are connected to one another that the folding chair can be collapsed into a bundle to be conveniently portable without occupying too much space; and the folding chair extended from the collapsed state provides improved stability and load capacity.

19 Claims, 4 Drawing Sheets

FOLDING CHAIR

BACKGROUND OF THE INVENTION

1. Field of the Invention

The present disclosure relates to a folding chair, and more particularly, to a folding chair that is collapsible into a bundle for storage and is extendable for use.

2. Description of the Related Art

A conventional folding chair usually includes a frame, two legs, a seat and a backrest. The legs are pivotally connected to the frame in a crisscross pattern; the seat is pivotally assembled to the frame; and the backrest is assembled to a top of the frame. In this manner, the legs and the seat can be pivotally extended to one side of the frame for a user to sit on the seat, or the legs and the seat can be pivotally moved toward the frame into a collapsed state.

With regard to the above-described conventional folding chair, when it is collapsed with the legs and the seat pivotally moved toward the frame, the frame and the seat still maintain an overall width the same as that of the folding chair in the extended state. Therefore, the conventional folding chair in the collapsed state would still occupy a relatively large space and is not conveniently portable. Further, the conventional folding chair in the extended state is supported on the floor or ground only by a bottom of the frame and the two legs, which provide only limited stability and load capacity.

Thus, it is tried by the inventor to develop an improved folding chair that can be collapsed into a bundle without occupying too much space to be easily portable, and on the other hand, can be extended into a standing state with high stability and providing good load capacity.

BRIEF SUMMARY OF THE INVENTION

An objective of the present disclosure is to eliminate the drawbacks of the conventional folding chair by providing an improved folding chair that can be collapsed into a bundle without occupying too much space to be easily portable, and on the other hand, can be extended into a standing state with high stability and providing good load capacity.

To achieve at least the above objective, the present disclosure provides a folding chair, which includes a right seat receiver, a right front leg, a right rear leg, a right armrest, a right armrest post, a right leg connecting member, a right backrest support, a first right front support, a second right front support, a first right rear support, a second right rear support, a right seat receiver pivot, a right front limiter, a right armrest holder, a right rear leg slider, a right slider, a right backrest support slider, a right post slider, a right front leg base, a right rear leg holder and a right rear limiter; a left seat receiver, a left front leg, a left rear leg, a left armrest, a left armrest post, a left leg connecting member, a left backrest support, a first left front support, a second left front support, a first left rear support, a second left rear support, a left seat receiver pivot, a left front limiter, a left armrest holder, a left rear leg slider, a left slider, a left backrest support slider, a left post slider, a left front leg base, a left rear leg holder and a left rear limiter; a middle seat receiver, a middle front leg, a middle rear leg, a middle seat receiver post, a middle leg connecting member, a middle backrest support, a middle seat receiver pivot, a middle rear leg slider, a middle slider, a middle backrest support slider, a middle post slider, a middle front leg base, a middle rear leg holder and a middle rear limiter; a seat; and a backrest. The right seat receiver is movably connected near a front end to the right seat pivot and movably connected at a rear end to the right rear leg slider; the right front leg is movably connected to the right seat receiver with a rear upper end of the right front leg movably connected to the right backrest support slider and a front lower end of the right front leg movably connected to the right front leg base; the right rear leg is movably extended through the right rear leg slider to be movably connected at a front upper end to the right rear leg holder and the right front leg; the right armrest is movably connected at a rear end to the right backrest support and near a front end to the right armrest holder; the right armrest post has the right seat receiver pivot movably mounted thereto, and is movably connected at an upper end to the right armrest holder and movably connected at a lower end to the right post slider, which is movably fitted near to around the front lower end of the right front leg; the right leg connecting member is movably connected at a front end to the right front leg and is pivotally connected at a rear end to the right slider, which is movably provided on the right rear leg; the right backrest support is also pivotally connected at a lower end to the right slider and has the right backrest support slider movably fitted therearound; the right front limiter is mounted on the right armrest post to upward abut against the right seat receiver pivot; and the right rear limiter is mounted on the right rear leg to forward abut against the right slider. The left seat receiver is movably connected near a front end to the left seat pivot and movably connected at a rear end to the left rear leg slider; the left front leg is movably connected to the left seat receiver with a rear upper end of the left front leg movably connected at to the left backrest support slider and a front lower end of the left front leg movably connected to the left front leg base; the left rear leg is movably extended through the left rear leg slider to be movably connected at a front upper end to the left rear leg holder and the left front leg; the left armrest is movably connected at a rear end to the left backrest support and near a front end to the left armrest holder; the left armrest post has the left seat receiver pivot movably mounted thereto, and is movably connected at an upper end to the left armrest holder and movably connected at a lower end to the left post slider, which is movably fitted near to around the front lower end of the left front leg; the left leg connecting member is movably connected at a front end to the left front leg and is pivotally connected at a rear end to the left slider, which is movably provided on the left rear leg; the left backrest support is also pivotally connected at a lower end to the left slider and has the left backrest support slider movably fitted therearound; the left front limiter is mounted on the left armrest post to upward abut against the left seat receiver pivot; and the left rear limiter is mounted on the left rear leg to forward abut against the left slider. The middle seat receiver is movably connected near a front end to the middle seat receiver pivot and has a rear end movably connected to the middle rear leg slider; the middle front leg is movably connected to the middle seat receiver and has a rear upper end movably connected to the middle backrest support slider and a front lower end movably connected to the middle front leg base; the middle rear leg is extended through the middle rear leg slider and has a front upper end movably connected to the middle rear leg holder, which is also movably connected to the middle front leg; the middle seat receiver post is connected at an upper end to the middle seat receiver pivot movably provided on the middle seat receiver, and is movably connected at a lower end to the middle post slider, which is movably fitted around the front lower end of the middle front leg; the middle leg connecting member has a front end movably connected to the middle front leg; a rear end of the middle leg connecting member and a lower end of the middle backrest support are pivotally connected to the middle slider, which is movably provided on the middle rear leg; the middle backrest support slider is movably fitted around the middle backrest support; and the middle rear limiter is also provided on the middle rear leg. The first right front support and the second right front support are movably connected to one another in a crisscross pattern; the first right front support has an upper end movably connected to the right seat receiver pivot and a lower end movably connected to the middle front leg base; and the second right front support has an upper end movably connected to the middle seat receiver pivot and a lower end movably connected to the right front leg base. The first right rear support and the second right rear support are movably connected to one another in a crisscross pattern; the first right rear support has an upper end movably connected to the right backrest support slider and a lower end movably connected to the middle slider; and the second right rear support has an upper end movably connected to the middle backrest support slider and a lower end movably connected to the right slider. The first left front support and the second left front support are movably connected to one another in a crisscross pattern; the first left front support has an upper end movably connected to the left seat receiver pivot and a lower end movably connected to the middle front leg base; and the second left front support has an upper end movably connected to the middle seat receiver pivot and a lower end movably connected to the left front leg base. The first left rear support and the second left rear support are movably connected to one another in a crisscross pattern; the first left rear support has an upper end movably connected to the left backrest support slider and a lower end movably connected to the middle slider; and the second left rear support has an upper end movably connected to the middle backrest support slider and a lower end movably connected to the left slider. The seat is located among the right seat receiver, the left seat receiver and the middle seat receiver; and the backrest is located among the right backrest support, the left backrest support and the middle backrest support.

In an embodiment of the folding chair, the right seat receiver pivot includes a first pivot section, a first cradle section and a first sleeve section; the first cradle section is located on a top of the first pivot section, and the first sleeve section is located at one side of the first pivot section; the first right front support is movably connected at its upper end to the first pivot section, the right seat receiver is movably connected near its front end to the first cradle section; and the right armrest post is movably extended through the first sleeve section, which is downward abutted on the right front limiter provided on the right armrest post.

In an embodiment of the folding chair, the right rear leg slider includes a second sleeve section and a second pivot section located at one side of the first sleeve section; the right rear leg is movably extended through the second sleeve section; and the right seat receiver is movably connected at its rear end to the second pivot section.

In an embodiment of the folding chair, the right rear leg holder includes a third pivot section and a fourth pivot section located at one side of the third pivot section; the third pivot section is movably connected to a point of the right front leg between two ends thereof; and the fourth pivot section is movably connected to the front upper end of the right rear leg.

In an embodiment of the folding chair, the right backrest support slider includes a third sleeve section, a fifth pivot section located at one side of the third sleeve section, and a sixth pivot section located at another side of the third sleeve section; the right backrest support is movably extended through the third sleeve section; the fifth pivot section is movably connected to the rear upper end of the right front leg; and the sixth pivot section is movably connected to the upper end of the first right rear support.

In an embodiment of the folding chair, the right slider includes a fourth sleeve section, and a seventh and an eighth pivot section separately located at two opposite sides of the fourth sleeve section; the right rear leg is movably extended through the fourth sleeve section; the seventh pivot section is movably connected to the lower end of the right backrest support; and the eighth pivot section is movably connected to the rear end of the right leg connecting member.

In an embodiment of the folding chair, the left seat receiver pivot includes a ninth pivot section, a second cradle section and a fifth sleeve section; the second cradle section is located on a top of the ninth pivot section, and the fifth sleeve section is located at one side of the ninth pivot section; the first left front support is movably connected at its upper end to the ninth pivot section; the left seat receiver is movably connected near its front end to the second cradle section; and the left armrest post is movably extended through the fifth sleeve section, which is downward abutted on the left front limiter provided on the left armrest post.

In an embodiment of the folding chair, the left rear leg slider includes a sixth sleeve section and a tenth pivot section located at one side of the sixth sleeve section; the left rear leg is movably extended through the sixth sleeve section; and the left seat receiver is movably connected at its rear end to the tenth pivot section.

In an embodiment of the folding chair, the left rear leg holder includes an eleventh pivot section and a twelfth pivot section located at one side of the eleventh pivot section; the eleventh pivot section is movably connected to a point of the left front leg between two ends thereof; and the twelfth pivot section is movably connected to the front upper end of the left rear leg.

In an embodiment of the folding chair, the left backrest support slider includes a seventh sleeve section, a thirteenth pivot section located at one side of the seventh sleeve section, and a fourteenth pivot section located at another side of the seventh sleeve section; the left backrest support is movably extended through the seventh sleeve section; the thirteenth pivot section is movably connected to the rear upper end of the left front leg; and the fourteenth pivot section is movably connected to the upper end of the first left rear support.

In an embodiment of the folding chair, the left slider includes an eighth sleeve section, and a fifteenth and a sixteenth pivot section separately located at two opposite sides of the eighth sleeve section; the left rear leg is movably extended through the eighth sleeve section; the fifteenth pivot section is movably connected to the lower end of the left backrest support; and the sixteenth pivot section is movably connected to the rear end of the left leg connecting member.

In an embodiment of the folding chair, the middle seat receiver pivot includes a seventeenth pivot section, an eighteenth pivot section and a third cradle section; the seventeenth and the eighteenth pivot section are separately located at two sides of the third cradle section; the seventeenth pivot section is movably connected to the upper end of the second right front support; the eighteenth pivot section is movably connected to the upper end of the second left front support; and the middle seat receiver is movably connected near its front end to the third cradle section.

In an embodiment of the folding chair, the middle rear leg slider includes a ninth sleeve section and a nineteenth pivot section located at one side of the ninth sleeve section; the middle rear leg is movably extended through the ninth sleeve section; and the middle seat receiver is movably connected at its rear end to the nineteenth pivot section.

In an embodiment of the folding chair, the middle rear leg holder includes a twentieth pivot section and a twenty-first pivot section located at one side of the twentieth pivot section; the twentieth pivot section is movably connected to a point of the middle front leg between two ends thereof, and the twenty-first pivot section is movably connected to the upper end of the middle rear leg.

In an embodiment of the folding chair, the middle backrest support slider includes a tenth sleeve section, a twenty-second pivot section, a twenty-third pivot section and a twenty-fourth pivot section; the twenty-fourth pivot section is located at a front end of the tenth sleeve section, and the twenty-second section and the twenty-third section are separately located at two opposite sides of the tenth sleeve section; the middle backrest support is movably extended through the tenth sleeve section; the twenty-second pivot section is movably connected to the upper end of the second right rear support; the twenty-third pivot section is movably connected to the upper end of the second left rear support; and the twenty-fourth pivot section is movably connected to the rear upper end of the middle front leg.

In an embodiment of the folding chair, the middle slider includes an eleventh sleeve section, a twenty-fifth pivot section, a twenty-sixth pivot section, a twenty-seventh pivot section and a twenty-eighth pivot section; the twenty-fifth and the twenty-sixth pivot section are separately located at two opposite ends of the eleventh sleeve section; the twenty-seventh and the twenty-eighth pivot section are located at the same end of the eleventh sleeve section; the middle rear leg is movably extended through the eleventh sleeve section; the middle backrest support is movably connected at its lower end to the twenty-fifth pivot section; the middle leg connecting member is movably connected at its rear end to the twenty-sixth pivot section; the first right rear support is movably connected at its lower end to the twenty-seventh pivot section; and the first left rear support is movably connected at its lower end to the twenty-eighth pivot section.

In an operable embodiment, the folding chair further includes a right link and a left link; the right link is movably connected at a rear end to the right seat receiver and is movably assembled at a front end to the right front limiter; and the left link is movably connected at a rear end to the left seat receiver and is movably assembled at a front end to the left front limiter.

In an operable embodiment, the folding chair further includes a right rear leg base, a left rear leg base and a middle rear leg base; the right rear leg base is connected to a rear lower end of the right rear leg; the left rear leg base is connected to a rear lower end of the left rear leg; and the middle rear leg base is connected to a rear lower end of the middle rear leg.

In an embodiment of the folding chair, the backrest and the seat are connected to each other.

With the above arrangements, the folding chair of the present disclosure can be collapsed into a bundle to be easily portable without occupying too much space; and the folding chair extended from the collapsed state provides improved stability and load capacity.

DETAILED DESCRIPTION OF THE INVENTION

To facilitate understanding of the objectives, characteristics and effects of this present disclosure, embodiments together with the attached drawings for the detailed description of the present disclosure are provided.

Figure 2:
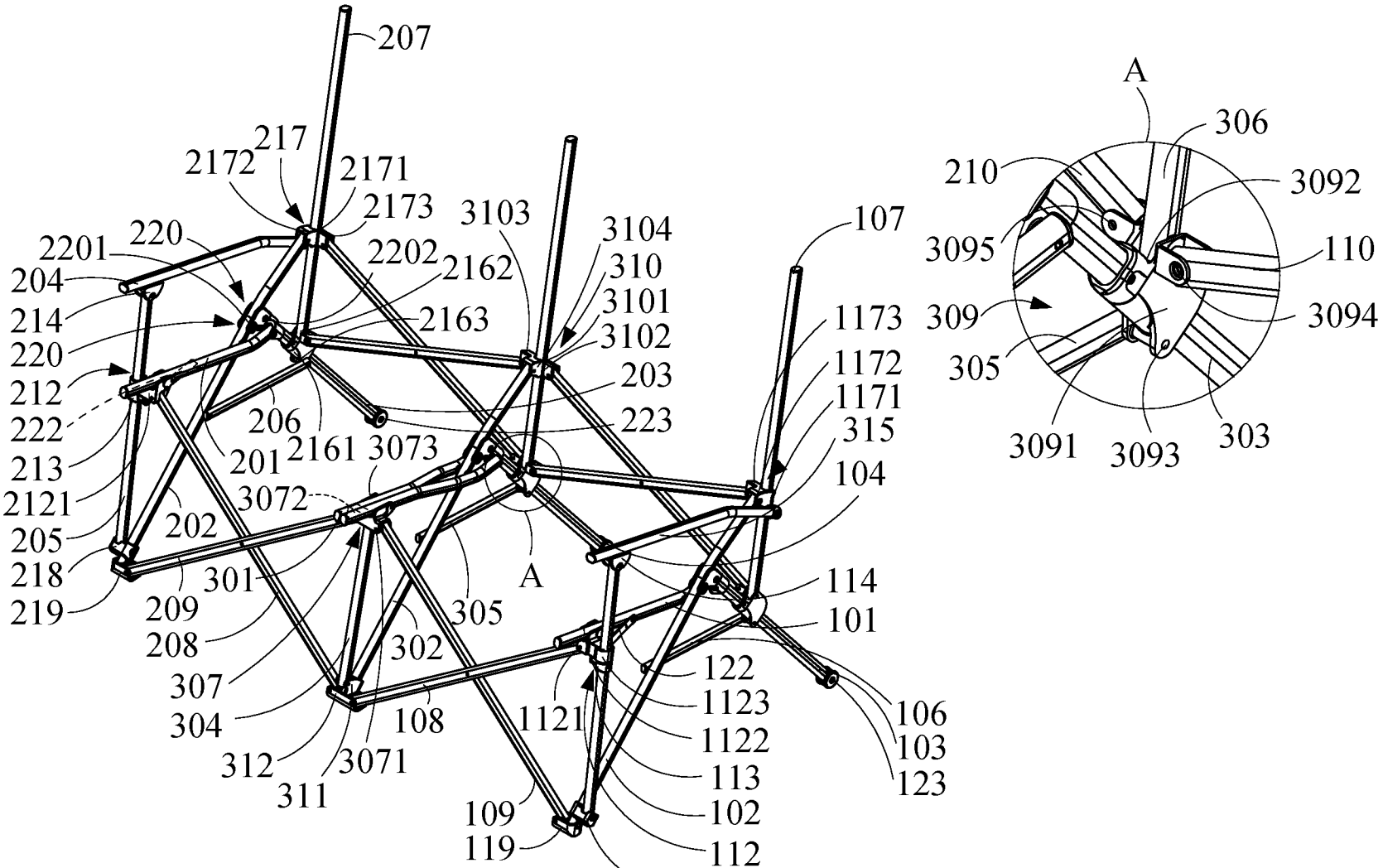
FIG. 2 is a perspective view of the folding chair of FIG. 2 in the extended state with a seat and a backrest omitted therefrom.
Figure 3:
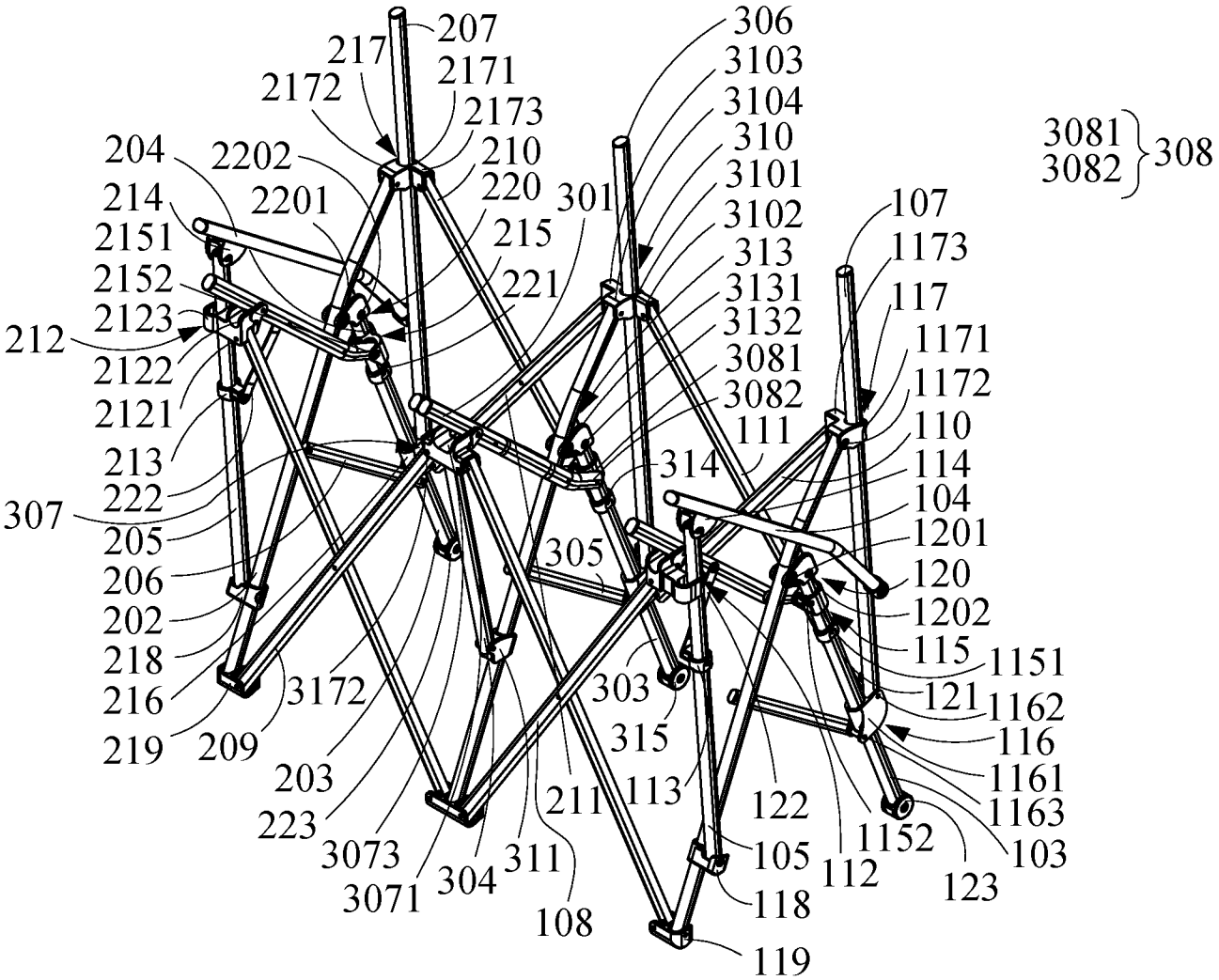
FIG. 3 is a perspective view showing the folding chair of FIG. 2 without the seat and the backrest in a partially collapsed state.
Figure 4:
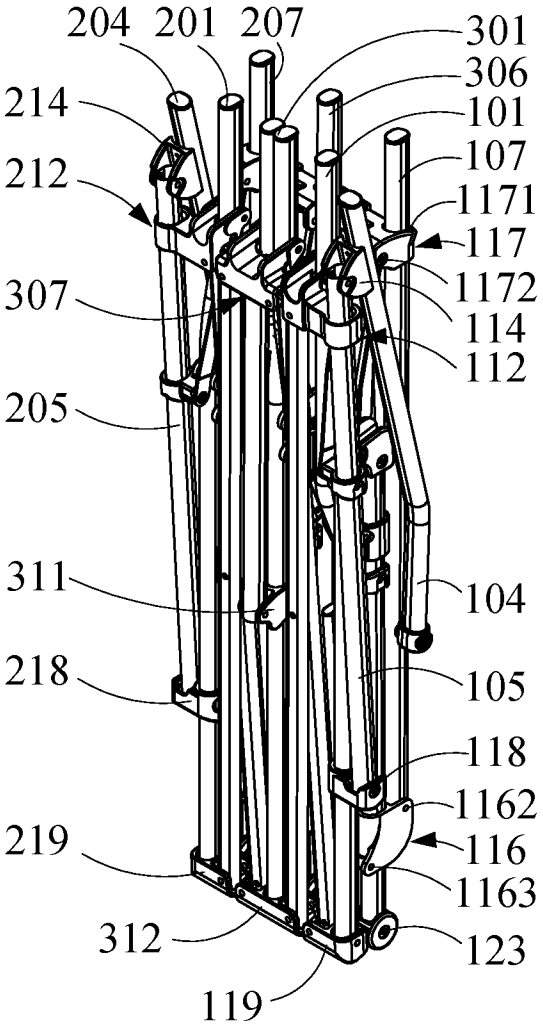
FIG. 4 is a perspective view showing the folding chair of FIG. 2 in a fully collapsed state.

Referring to FIGS. 2 to 4. As shown, a folding chair according to an embodiment of the present disclosure includes a right seat receiver 101, a right front leg 102, a right rear leg 103, a right armrest 104, a right armrest post 105, a right leg connecting member 106, a right backrest support 107, a first right front support 108, a second right front support 109, a first right rear support 110, a second right rear support 111, a right seat receiver pivot 112, a right front limiter 113, a right armrest holder 114, a right rear leg slider 115, a right slider 116, a right backrest support slider 117, a right post slider 118, a right front leg base 119, a right rear leg holder 120, a right rear limiter 121, a right link 122 and a right rear leg base 123; a left seat receiver 201, a left front leg 202, a left rear leg 203, a left armrest 204, a left armrest post 205, a left leg connecting member 206, a left backrest support 207, a first left front support 208, a second left front support 209, a first left rear support 210, a second left rear support 211, a left seat receiver pivot 212, a left front limiter 213, a left armrest holder 214, a left rear leg slider 215, a left slider 216, a left backrest support slider 217, a left post slider 218, a left front leg base 219, a left rear leg holder 220, a left rear limiter 221, a left link 222 and a left rear leg base 223; a middle seat receiver 301, a middle front leg 302, a middle rear leg 303, a middle seat receiver post 304, a middle leg connecting member 305, a middle backrest support 306, a middle seat receiver pivot 307, a middle rear leg slider 308, a middle slider 309, a middle backrest support slider 310, a middle post slider 311, a middle front leg base 312, a middle rear leg holder 313, a middle rear limiter 314 and a middle rear leg base 315; a seat 401; and a backrest 501.

The right seat receiver 101 is movably connected near a front end to the right seat pivot 112 and movably connected at a rear end to the right rear leg slider 115. The right front leg 102 is movably connected to the right seat receiver 101 with a rear upper end of the right front leg 102 movably connected to the right backrest support slider 117 and a front lower end of the right front leg 102 movably connected to the right front leg base 119. The right rear leg 103 is movably extended through the right rear leg slider 115 to be movably connected at a front upper end to the right rear leg holder 120 and the right front leg 102, and is connected at a rear lower end to the right rear leg base 123. The right armrest 104 is movably connected at a rear end to the right backrest support 107 and near a front end to the right armrest holder 114. The right armrest post 105 has the right seat receiver pivot 112 movably mounted thereto, and is movably connected at an upper end to the right armrest holder 114 and movably connected at a lower end to the right post slider 118, which is movably fitted near to around the front lower end of the right front leg 102. The right leg connecting member 106 is movably connected at a front end to the right front leg 102 and is pivotally connected at a rear end to the right slider 116, which is movably provided on the right rear leg 103. The right backrest support 107 is also pivotally connected at a lower end to the right slider 116 and has the right backrest support slider 117 movably fitted therearound. The right front limiter 113 is mounted on the right armrest post 105 to upward abut against the right seat receiver pivot 112. The right rear limiter 121 is mounted on the right rear leg 103 to forward abut against the right slider 116. The right link 122 is movably connected at a rear end to the right seat receiver 101 and is movably assembled at a front end to the right front limiter 113.

The left seat receiver 201 is movably connected near a front end to the left seat pivot 212 and movably connected at a rear end to the left rear leg slider 215. The left front leg 202 is movably connected to the left seat receiver 201 with a rear upper end of the left front leg 202 movably connected at to the left backrest support slider 217 and a front lower end of the left front leg 202 movably connected to the left front leg base 219. The left rear leg 203 is movably extended through the left rear leg slider 215 to be movably connected at a front upper end to the left rear leg holder 220 and the left front leg 202, and is connected at a rear lower end to the left rear leg base 223. The left armrest 204 is movably connected at a rear end to the left backrest support 207 and near a front end to the left armrest holder 214. The left armrest post 205 has the left seat receiver pivot 212 movably mounted thereto, and is movably connected at an upper end to the left armrest holder 214 and movably connected at a lower end to the left post slider 218, which is movably fitted near to around the front lower end of the left front leg 202. The left leg connecting member 206 is movably connected at a front end to the left front leg 202 and is pivotally connected at a rear end to the left slider 216, which is movably provided on the left rear leg 203. The left backrest support 207 is also pivotally connected at a lower end to the left slider 216 and has the left backrest support slider 217 movably fitted therearound. The left front limiter 213 is mounted on the left armrest post 205 to upward abut against the left seat receiver pivot 212. The left rear limiter 221 is mounted on the left rear leg 203 to forward abut against the left slider 216. The left link 222 is movably connected at a rear end to the left seat receiver 201 and is movably assembled at a front end to the left front limiter 213.

The middle seat receiver 301 is movably connected near a front end to the middle seat receiver pivot 307 and has a substantially V-shaped rear end movably connected to the middle rear leg slider 308. The middle front leg 302 is movably connected to the middle seat receiver 301 and has a rear upper end movably connected to the middle backrest support slider 310 and a front lower end movably connected to the middle front leg base 312. The middle rear leg 303 is extended through the middle rear leg slider 308 and has a front upper end movably connected to the middle rear leg holder 313, which is also movably connected to the middle front leg 302, and the middle rear leg 303 has a rear lower end connected to the middle rear leg base 315. The middle seat receiver post 304 is connected at an upper end to the middle seat receiver pivot 307 movably provided on the middle seat receiver 301, and is movably connected at a lower end to the middle post slider 311, which is movably fitted around the front lower end of the middle front leg 302. The middle leg connecting member 305 has a front end movably connected to the middle front leg 302. A rear end of the middle leg connecting member 305 and a lower end of the middle backrest support 306 are pivotally connected to the middle slider 309, which is movably provided on the middle rear leg 303. The middle backrest support slider 310 is movably fitted around the middle backrest support 306. The middle rear limiter 314 is also provided on the middle rear leg 303.

The first right front support 108 and the second right front support 109 are movably connected to one another in a crisscross pattern. The first right front support 108 has an upper end movably connected to the right seat receiver pivot 112 and a lower end movably connected to the middle front leg base 312. The second right front support 109 has an upper end movably connected to the middle seat receiver pivot 307 and a lower end movably connected to the right front leg base 119.

The first right rear support 110 and the second right rear support 111 are movably connected to one another in a crisscross pattern. The first right rear support 110 has an upper end movably connected to the right backrest support slider 117 and a lower end movably connected to the middle slider 309. The second right rear support 111 has an upper end movably connected to the middle backrest support slider 310 and a lower end movably connected to the right slider 116.

The first left front support 208 and the second left front support 209 are movably connected to one another in a crisscross pattern. The first left front support 208 has an upper end movably connected to the left seat receiver pivot 212 and a lower end movably connected to the middle front leg base 312. The second left front support 209 has an upper end movably connected to the middle seat receiver pivot 307 and a lower end movably connected to the left front leg base 219.

The first left rear support 210 and the second left rear support 211 are movably connected to one another in a crisscross pattern. The first left rear support 210 has an upper end movably connected to the left backrest support slider 217 and a lower end movably connected to the middle slider 309. The second left rear support 211 has an upper end movably connected to the middle backrest support slider 310 and a lower end movably connected to the left slider 216.

Figure 1:
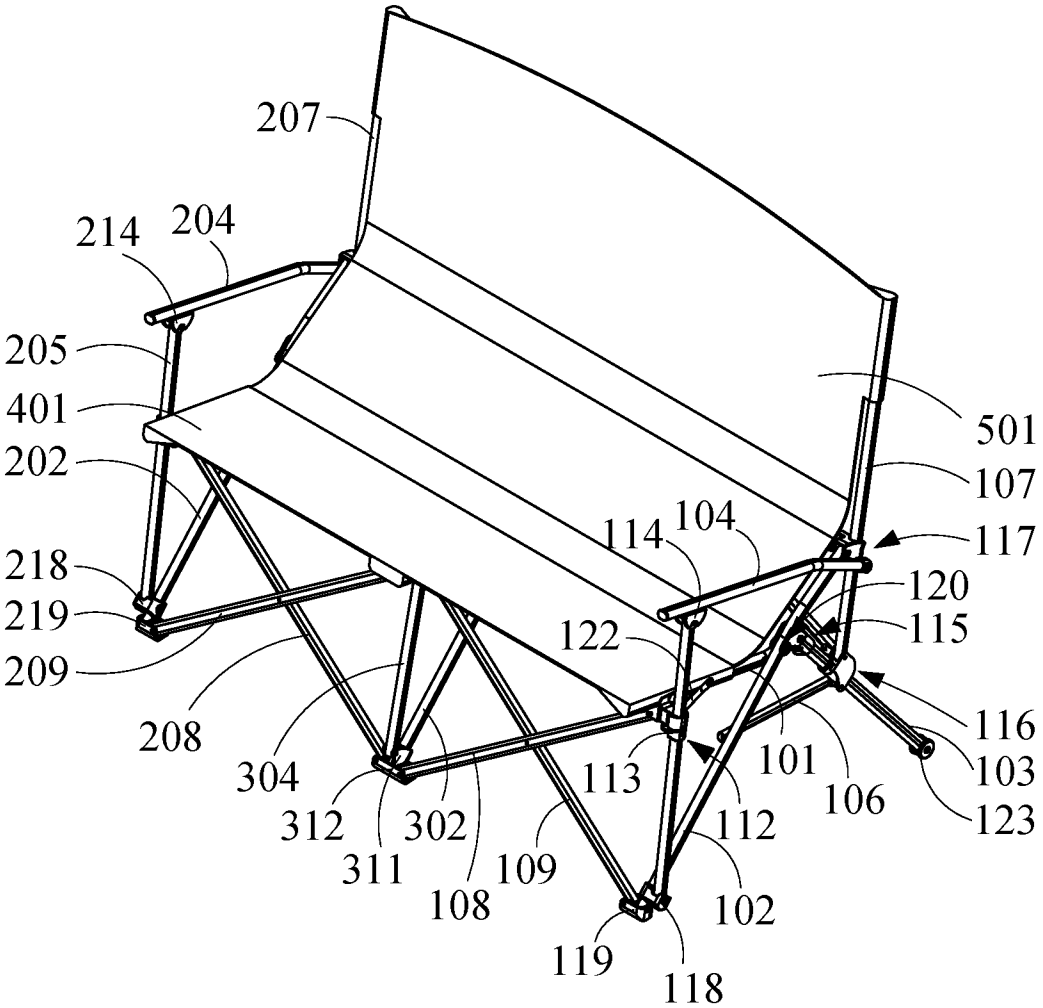
FIG. 1 is a perspective view of a folding chair according to an embodiment of the present disclosure, showing the folding chair in a fully extended state.

The seat 401 is located among the right seat receiver 101, the left seat receiver 201 and the middle seat receiver 301. The backrest 501 is located among the right backrest support 107, the left backrest support 207 and the middle backrest support 306. As shown in FIG. 1, the backrest 501 and the seat 401 are connected to each other to enable an increased stability for sitting. A user (not shown) may comfortably sit on the seat 401 with his/her back rest on the backrest 501.

Please refer to FIGS. 2 to 4. The collapsing of the folding chair of the present disclosure can be started from either the right or the left side of the chair. In the case of starting from the right side of the chair, first grip the right backrest support 107, preferably, at an upper end thereof while hold the right seat receiver 101 at its front end, and move the right seat receiver 101 toward the right backrest support 107, so that the right seat receiver 101 is moved out of and can be turned at the right seat receiver pivot 112 to be pivotally turned relative to the right front leg 102. At this point, the right front leg 102 is caused to move the right slider 116, which in turn brings the right backrest support 107 and the right leg connecting member 106 to simultaneously shift toward the right rear leg 103, such that the right rear leg 103, along with the right rear leg base 123, is shifted toward the right front leg 102. At this point, the right link 122 brings the right front limiter 113 to move away from a lower side of the right seat receiver pivot 112, allowing the first right front support 108 to bring the middle front leg base 312 to move toward the right front leg base 119 while the right rear leg slider 115 slides along the right rear leg 103 away from the right rear leg holder 120. At this point, with the help of the right post slider 118, the right armrest post 105 is brought by the right seat receiver pivot 112 to move upward. Via the right armrest holder 114 connected to between the right armrest 104 and the right armrest post 105, the upward moving right armrest post 105 also pushes the right armrest 104 toward the right backrest support 107. When the right front leg 102 is moved, it brings the right backrest support slider 117 to move upward along the right backrest support 107, and the upward moving right backrest support slider 117 in turn brings the first right rear support 110 to move toward the right backrest support 107.

When collapsing the folding chair of the present disclosure from the right side thereof in the sequence described in the previous paragraph, the left seat receiver 201 is also caused to move toward the left backrest support 207, so that the left seat receiver 201 is moved out of and can be turned at the left seat receiver pivot 212 to be pivotally turned relative to the left front leg 202. At this point, the left front leg 202 is caused to move the left slider 216, which in turn brings the left backrest support 207 and the left leg connecting member 206 to simultaneously shift toward the left rear leg 203, such that the left rear leg 203, along with the left rear leg base 223, is shifted toward the left front leg 202. At this point, the left link 222 brings the left front limiter 213 to move away from a lower side of the left seat receiver pivot 212, allowing the first left front support 208 to bring the left seat receiver pivot 212 to move toward the middle seat receiver pivot 307 while the left rear leg slider 215 slides along the left rear leg 203 away from the left rear leg holder 220. At this point, with the help of the left post slider 218, the left armrest post 205 is brought by the left seat receiver pivot 212 to move upward. Via the left armrest holder 214 connected to between the left armrest 204 and the left armrest post 205, the upward moving left armrest post 205 also pushes the left armrest 204 toward the left backrest support 207. When the left front leg 202 is moved, it brings the left backrest support slider 217 to move upward along the left backrest support 207, and the upward moving left backrest support slider 217 in turn brings the first left rear support 210 to move toward the middle backrest support 306.

Further, when collapsing the folding chair of the present disclosure in the sequence described in the above two paragraphs, the middle seat receiver 301 is also caused to move toward the middle backrest support 306, so that the middle seat receiver 301 is moved out of and can be turned at the middle seat receiver pivot 307 to be pivotally turned relative to the middle front leg 302. At this point, the middle front leg 302 is caused to move the middle slider 309, which in turn brings the first right rear support 110 and the first left rear support 210 to move simultaneously. Meanwhile, the middle slider 309 moves the middle backrest support 306 and the middle leg connecting member 305 toward the middle rear leg 303 at the same time, so that the middle rear leg 303, along with the middle rear leg base 315, is caused to move toward the middle front leg 302. At this point, the middle rear leg slider 308 is brought to slide along the middle rear leg 303 away from the middle rear leg holder 313. Further, the middle seat receiver pivot 307 cooperates with the middle post slider 311 to push the middle front leg 302 toward the middle backrest support 306; and the middle seat receiver pivot 307 also causes the second right front support 109 and the second left front support 209 to move simultaneously. Meanwhile, the middle front leg base 312 causes the first right front support 108 and the first left front support 208 to move simultaneously. When the middle front leg 302 moves, it also brings the middle backrest support slider 310 to move upward along the middle backrest support 306. The upwardly moving middle backrest support slider 310 causes the second right rear support 111 and the second left rear support 211 to move toward the middle backrest support 306 at the same time. Therefore, the folding chair of the present disclosure is completely collapsed into a bundled state, allowing it to be easily portable without occupying too much space.

Moreover, when the folding chair of the present disclosure is in the collapsed state or in the extended state, the right front leg base 119, the right seat receiver pivot 112, the right rear leg base 123, the left front leg base 219, the left seat receiver pivot 212, the left rear leg base 223, the middle seat receiver pivot 307, the middle front leg base 312 and the middle rear leg base 315 can be used not only as a protection for the right front leg 102, the right rear leg 103, the first right front support 108, the second right front support 109, the left front leg 202, the left rear leg 203, the first left front support 208, the second left front support 209, the middle front leg 302 and the middle rear leg 303, respectively, to safeguard the folding chair against damage caused by direct contact with the ground or floor, but also as anti-slip means to give the folding chair even better stability and load capacity.

In the embodiment of the present disclosure illustrated in FIGS. 2 to 4, the right seat receiver pivot 112 includes a first pivot section 1121, a first cradle section 1122 and a first sleeve section 1123. The first cradle section 1122 is located on a top of the first pivot section 1121, and the first sleeve section 1123 is located at one side of the first pivot section 1121. The first right front support 108 is movably connected at its upper end to the first pivot section 1121, the right seat receiver 101 is movably connected near its front end to the first cradle section 1122, and the right armrest post 105 is movably extended through the first sleeve section 1123, which is downward abutted on the right front limiter 113 provided on the right armrest post 105. When extending the folding chair of the present disclosure from the collapsed state, the right seat receiver 101 is moved into the first cradle section 1122 to assemble them to each other; and the first pivot section 1121 of the right seat receiver pivot 112 can bring the first right front support 108 to move. These arrangements not only enable the right seat receiver pivot 112 to easily move the first right front support 108, but also enable the first right front support 108, the right seat receiver 101 and the right armrest post 105 in the extended state to provide improved stability and load capacity.

In the embodiment of the present disclosure illustrated in FIGS. 2 to 4, the right rear leg slider 115 includes a second sleeve section 1151 and a second pivot section 1152 located at one side of the first sleeve section 1151. The right rear leg 103 is movably extended through the second sleeve section 1151, and the right seat receiver 101 is movably connected at its rear end to the second pivot section 1152. To collapse or to extend the folding chair of the present disclosure, the second sleeve section 1151 of the right rear leg slider 115 is downwardly or upwardly, respectively, slid along the right rear leg 103, and the front end of the right seat receiver 101, which is movably connected at the rear end to the second pivot section 1152, can be moved out of or moved into the first cradle section 1122, respectively. These arrangements not only enable the right rear leg slider 115 to be smoothly moved when the folding chair is collapsed or extended, but also enable the right seat receiver 101 and the right rear leg 103 in the extended state to provide improved stability and load capacity.

In the embodiment of the present disclosure illustrated in FIGS. 2 to 4, the right rear leg holder 120 includes a third pivot section 1201 and a fourth pivot section 1202 located at one side of the third pivot section 1201. The third pivot section 1201 is movably connected to a point of the right front leg 102 between two ends thereof, and the fourth pivot section 1202 is movably connected to the front upper end of the right rear leg 103. When collapsing or extending the folding chair of the present disclosure, the right rear leg 103 can be pivotally turned at the fourth pivot section 1202 to move toward the right front leg 102 or to move away from the right front leg 102, respectively; and the right front leg 102 can be pivotally turned at the third pivot section 1201 to move toward the right rear leg 103 or to move away from the right rear leg 103, respectively. These arrangements not only enable the right rear leg 103 and the right front leg 102 to be smoothly moved when collapsing or extending the folding chair, but also enable the right rear leg 103 and the right front leg 102 in the extended state to provide improved stability and load capacity.

In the embodiment of the present disclosure illustrated in FIGS. 2 to 4, the right backrest support slider 117 includes a third sleeve section 1171, a fifth pivot section 1172 located at one side of the third sleeve section 1171, and a sixth pivot section 1173 located at another side of the third sleeve section 1171. The right backrest support 107 is movably extended through the third sleeve section 1171; the fifth pivot section 1172 is movably connected to the rear upper end of the right front leg 102; and the sixth pivot section 1173 is movably connected to the upper end of the first right rear support 110. When collapsing or extending the folding chair of the present disclosure, the third sleeve section 1171 allows the right backrest support slider 117 to be slid upward or downward, respectively, along the right backrest support 107, and the right front leg 102 can be pivotally turned at the fifth pivot section 1172 to move toward the right rear leg 103 or move away from the right rear leg 103, respectively, and meanwhile, the first right rear support 110 can be pivotally turned at the sixth pivot section 1173 to move toward the right backrest support 107 or move away from the right backrest support 107, respectively. These arrangements not only enable the right backrest support slider 117 to be smoothly moved when the folding chair is collapsed or extended, but also enable the right backrest support 107, the right front leg 102 and the first right rear support 110 in the extended state to provide improved stability and load capacity.

In the embodiment of the present disclosure illustrated in FIGS. 2 to 4, the right slider 116 includes a fourth sleeve section 1161, and a seventh and an eighth pivot section 1162, 1163 separately located at two opposite sides of the fourth sleeve section 1161. The right rear leg 103 is movably extended through the fourth sleeve section 1161; the seventh pivot section 1162 is movably connected to the lower end of the right backrest support 107; and the eighth pivot section 1163 is movably connected to the rear end of the right leg connecting member 106. With the fourth sleeve section 1161, the right slider 116 of the folding chair of the present disclosure can be smoothly slid along the right rear leg 103; and the right backrest support 107 and the right leg connecting member 106 can be pivotally turned at the seventh pivot section 1162 and the eighth pivot section 1163, respectively, to move toward the right rear leg 103 at the same time. These arrangements not only enable the right backrest support 107 and the right leg connecting member 106 to be smoothly moved when the folding chair is collapsed or extended, but also enable the right backrest support 107 and the right leg connecting member 106 in the extended state to provide improved stability and load capacity.

In the embodiment of the present disclosure illustrated in FIGS. 2 to 4, the left seat receiver pivot 212 includes a ninth pivot section 2121, a second cradle section 2122 and a fifth sleeve section 2123. The second cradle section 2122 is located on a top of the ninth pivot section 2121, and the fifth sleeve section 2123 is located at one side of the ninth pivot section 2121. The first left front support 208 is movably connected at its upper end to the ninth pivot section 2121, the left seat receiver 201 is movably connected near its front end to the second cradle section 2122, and the left armrest post 205 is movably extended through the fifth sleeve section 2123, which is downward abutted on the left front limiter 213 provided on the left armrest post 205. When extending the folding chair of the present disclosure from the collapsed state, the left seat receiver 201 is moved into the second cradle section 2122 to assemble them to each other; and the ninth pivot section 2121 of the left seat receiver pivot 212 can bring the first left front support 208 to move. These arrangements not only enable the left seat receiver pivot 212 to easily move the first left front support 208, but also enable the left seat receiver 201, the left armrest post 205 and the first left front support 208 in the extended state to provide improved stability and load capacity.

In the embodiment of the present disclosure illustrated in FIGS. 2 to 4, the left rear leg slider 215 includes a sixth sleeve section 2151 and a tenth pivot section 2152 located at one side of the sixth sleeve section 2151. The left rear leg 203 is movably extended through the sixth sleeve section 2151, and the left seat receiver 201 is movably connected at its rear end to the tenth pivot section 2152. To collapse or to extend the folding chair of the present disclosure, the sixth sleeve section 2151 of the left rear leg slider 215 is downwardly or upwardly slid, respectively, along the left rear leg 203, and the front end of the left seat receiver 201, which is movably connected at the rear end to the tenth pivot section 2152, can be moved out of or moved into the second cradle section 2122, respectively. These arrangements not only enable the left rear leg slider 215 to be smoothly moved when the folding chair is collapsed or extended, but also enable the left seat receiver 201 and the left rear leg 203 in the extended state to provide improved stability and load capacity.

In the embodiment of the present disclosure illustrated in FIGS. 2 to 4, the left rear leg holder 220 includes an eleventh pivot section 2201 and a twelfth pivot section 2202 located at one side of the eleventh pivot section 2201. The eleventh pivot section 2201 is movably connected to a point of the left front leg 202 between two ends thereof, and the twelfth pivot section 2202 is movably connected to the front upper end of the left rear leg 203. When collapsing or extending the folding chair of the present disclosure, the left rear leg 203 can be pivotally turned at the twelfth pivot section 2202 to move toward the left front leg 202 or to move away from the left front leg 202, respectively; and the left front leg 202 can be pivotally turned at the eleventh pivot section 2201 to move toward the left rear leg 203 or to move away from the left rear leg 203, respectively. These arrangements not only enable the left rear leg 203 and the left front leg 202 to be smoothly moved when collapsing or extending the folding chair, but also enable the left rear leg 203 and the left front leg 202 in the extended state to provide improved stability and load capacity.

In the embodiment of the present disclosure illustrated in FIGS. 2 to 4, the left backrest support slider 217 includes a seventh sleeve section 2171, a thirteenth pivot section 2172 located at one side of the seventh sleeve section 2171, and a fourteenth pivot section 2173 located at another side of the seventh sleeve section 2171. The left backrest support 207 is movably extended through the seventh sleeve section 2171; the thirteenth pivot section 2172 is movably connected to the rear upper end of the left front leg 202; and the fourteenth pivot section 2173 is movably connected to the upper end of the first left rear support 210. When collapsing or extending the folding chair of the present disclosure, the seventh sleeve section 2171 allows the left backrest support slider 217 to be slid upward or downward, respectively, along the left backrest support 207, and the left front leg 202 can be pivotally turned at the thirteenth pivot section 2172 to move toward the left rear leg 203 or move away from the left rear leg 203, respectively, and meanwhile, the first left rear support 210 can be pivotally turned at the fourteenth pivot section 2173 to move toward the left backrest support 207 or move away from the left backrest support 207, respectively. These arrangements not only enable the left backrest support slider 217 to be smoothly moved when the folding chair is collapsed or extended, but also enable the left backrest support 207, the left front leg 202, and the first left rear support 210 in the extended state to provide improved stability and load capacity.

In the embodiment of the present disclosure illustrated in FIGS. 2 to 4, the left slider 216 includes an eighth sleeve section 2161, and a fifteenth and a sixteenth pivot section 2162, 2163 separately located at two opposite sides of the eighth sleeve section 2161. The left rear leg 203 is movably extended through the eighth sleeve section 2161; the fifteenth pivot section 2162 is movably connected to the lower end of the left backrest support 207; and the sixteenth pivot section 2163 is movably connected to the rear end of the left leg connecting member 206. With the eighth sleeve section 2161, the left slider 216 of the folding chair of the present disclosure can be smoothly slid along the left rear leg 203; and the left backrest support 207 and the left leg connecting member 206 can be pivotally turned at the fifteenth pivot section 2162 and the sixteenth pivot section 2163, respectively, to move toward the left rear leg 203 at the same time. These arrangements not only enable the left backrest support 207 and the left leg connecting member 206 to be smoothly moved when the folding chair is collapsed or extended, but also enable the left backrest support 207 and the left leg connecting member 206 in the extended state to provide improved stability and load capacity.

In the embodiment of the present disclosure illustrated in FIGS. 2 to 4, the middle seat receiver pivot 307 includes a seventeenth pivot section 3071, an eighteenth pivot section 3072 and a third cradle section 3073. The seventeenth and the eighteenth pivot section 3071, 3072 are separately located at two sides of the third cradle section 3073. The seventeenth pivot section 3071 is movably connected to the upper end of the second right front support 109, the eighteenth pivot section 3072 is movably connected to the upper end of the second left front support 209, and the middle seat receiver 301 is movably connected near its front end to the third cradle section 3073. When extending the folding chair of the present disclosure from the collapsed state, the middle seat receiver 301 is moved into the third cradle section 3073 to assemble them to each other; and the seventeenth and the eighteenth pivot section 3071, 3072 of the middle seat receiver pivot 307 can bring the second right front support 109 and the second left front support 209 to move, respectively. These arrangements not only enable the middle seat receiver pivot 307 to easily move the second right front support 109 and the second left front support 209, but also enable the second right front support 109 and the second left front support 209 in the extended state to provide improved stability and load capacity.

In the embodiment of the present disclosure illustrated in FIGS. 2 to 4, the middle rear leg slider 308 includes a ninth sleeve section 3081 and a nineteenth pivot section 3082 located at one side of the ninth sleeve section 3081. The middle rear leg 303 is movably extended through the ninth sleeve section 3081, and the middle seat receiver 301 is movably connected at its rear end to the nineteenth pivot section 3082. When collapsing or extending the folding chair of the present disclosure, these arrangements not only enable the middle seat receiver 301 and the middle rear leg 303 to be smoothly moved, but also enable the middle seat receiver 301 and the middle rear leg 303 in the extended state to provide improved stability and load capacity.

In the embodiment of the present disclosure illustrated in FIGS. 2 to 4, the middle rear leg holder 313 includes a twentieth pivot section 3131 and a twenty-first pivot section 3132 located at one side of the twentieth pivot section 3131. The twentieth pivot section 3131 is movably connected to a point of the middle front leg 302 between two ends thereof, and the twenty-first pivot section 3132 is movably connected to the upper end of the middle rear leg 303. When collapsing or extending the folding chair of the present disclosure, these arrangements not only enable the middle front leg 302 and the middle rear leg 303 to be smoothly moved, but also enable the middle front leg 302 and the middle rear leg 303 in the extended state to provide improved stability and load capacity.

In the embodiment of the present disclosure illustrated in FIGS. 2 to 4, the middle backrest support slider 310 includes a tenth sleeve section 3101, a twenty-second pivot section 3102, a twenty-third pivot section 3103, and a twenty-fourth pivot section 3104. The twenty-fourth pivot section 3104 is located at a front end of the tenth sleeve section 3101, and the twenty-second section 3102 and the twenty-third section 3103 are separately located at two opposite sides of the tenth sleeve section 3101. The middle backrest support 306 is movably extended through the tenth sleeve section 3101; the twenty-second pivot section 3102 is movably connected to the upper end of the second right rear support 111; the twenty-third pivot section 3103 is movably connected to the upper end of the second left rear support 211; and the twenty-fourth pivot section 3104 is movably connected to the rear upper end of the middle front leg 302. When collapsing or extending the folding chair of the present disclosure, these arrangements not only enable the middle backrest support 306, the second right rear support 111, the second left rear support 211 and the middle front leg 302 to be smoothly moved, but also enable the middle backrest support 306, the second right rear support 111, the second left rear support 211 and the middle front leg 302 in the extended state to provide improved stability and load capacity.

In the embodiment of the present disclosure illustrated in FIGS. 2 to 4, the middle slider 309 includes an eleventh sleeve section 3091, a twenty-fifth pivot section 3092, a twenty-sixth pivot section 3093, a twenty-seventh pivot section 3094 and a twenty-eighth pivot section 3095. The twenty-fifth and the twenty-sixth pivot section 3092, 3093 are separately located at two opposite ends of the eleventh sleeve section 3091. The twenty-seventh and the twenty-eighth pivot section 3094, 3095 are located at the same end of the eleventh sleeve section 3091. The middle rear leg 303 is movably extended through the eleventh sleeve section 3091; the middle backrest support 306 is movably connected at its lower end to the twenty-fifth pivot section 3092; the middle leg connecting member 305 is movably connected at its rear end to the twenty-sixth pivot section 3093; the first right rear support 110 is movably connected at its lower end to the twenty-seventh pivot section 3094; and the first left rear support 210 is movably connected at its lower end to the twenty-eighth pivot section 3095. These arrangements not only enable the middle rear leg 303, the middle leg connecting member 305, the middle backrest support 306, the first right rear support 110 and the first left rear support 210 to be smoothly moved when the folding chair is collapsed or extended, but also enable the middle rear leg 303, the middle leg connecting member 305, the middle backrest support 306, the first right rear support 110 and the first left rear support 210 in the extended state to provide improved stability and load capacity.

While the present disclosure has been described by means of a specific embodiment, numerous modifications and variations could be made thereto by those skilled in the art without departing from the scope and spirit of the present disclosure set forth in the claims.

What is claimed is:

1. A folding chair, comprising:

a right seat receiver, a right front leg, a right rear leg, a right armrest, a right armrest post, a right leg connecting member, a right backrest support, a first right front support, a second right front support, a first right rear support, a second right rear support, a right seat receiver pivot, a right front limiter, a right armrest holder, a right rear leg slider, a right slider, a right backrest support slider, a right post slider, a right front leg base, a right rear leg holder and a right rear limiter; a left seat receiver, a left front leg, a left rear leg, a left armrest, a left armrest post, a left leg connecting member, a left backrest support, a first left front support, a second left front support, a first left rear support, a second left rear support, a left seat receiver pivot, a left front limiter, a left armrest holder, a left rear leg slider, a left slider, a left backrest support slider, a left post slider, a left front leg base, a left rear leg holder and a left rear limiter; a middle seat receiver, a middle front leg, a middle rear leg, a middle seat receiver post, a middle leg connecting member, a middle backrest support, a middle seat receiver pivot, a middle rear leg slider, a middle slider, a middle backrest support slider, a middle post slider, a middle front leg base, a middle rear leg holder and a middle rear limiter; a seat; and a backrest;

the right seat receiver being movably connected near a front end to the right seat pivot and movably connected at a rear end to the right rear leg slider; the right front leg being movably connected to the right seat receiver with a rear upper end of the right front leg movably connected to the right backrest support slider and a front lower end of the right front leg movably connected to the right front leg base; the right rear leg being movably extended through the right rear leg slider to be movably connected at a front upper end to the right rear leg holder and the right front leg; the right armrest being movably connected at a rear end to the right backrest support and near a front end to the right armrest holder; the right armrest post having the right seat receiver pivot movably mounted thereto, and being movably connected at an upper end to the right armrest holder and movably connected at a lower end to the right post slider, which is movably fitted near to around the front lower end of the right front leg; the right leg connecting member being movably connected at a front end to the right front leg and being pivotally connected at a rear end to the right slider, which is movably provided on the right rear leg; the right backrest support also being pivotally connected at a lower end to the right slider and having the right backrest support slider movably fitted therearound; the right front limiter being mounted on the right armrest post to upward abut against the right seat receiver pivot; and the right rear limiter being mounted on the right rear leg to forward abut against the right slider;

the left seat receiver being movably connected near a front end to the left seat pivot and movably connected at a rear end to the left rear leg slider; the left front leg being movably connected to the left seat receiver with a rear upper end of the left front leg movably connected at to the left backrest support slider and a front lower end of the left front leg movably connected to the left front leg base; the left rear leg being movably extended through the left rear leg slider to be movably connected at a front upper end to the left rear leg holder and the left front leg; the left armrest being movably connected at a rear end to the left backrest support and near a front end to the left armrest holder; the left armrest post having the left seat receiver pivot movably mounted thereto, and being movably connected at an upper end to the left armrest holder and movably connected at a lower end to the left post slider, which is movably fitted near to around the front lower end of the left front leg; the left leg connecting member being movably connected at a front end to the left front leg and being pivotally connected at a rear end to the left slider, which is movably provided on the left rear leg; the left backrest support also being pivotally connected at a lower end to the left slider and having the left backrest support slider movably fitted therearound; the left front limiter being mounted on the left armrest post to upward abut against the left seat receiver pivot; and the left rear limiter being mounted on the left rear leg to forward abut against the left slider;

the middle seat receiver being movably connected near a front end to the middle seat receiver pivot and having a rear end movably connected to the middle rear leg slider; the middle front leg being movably connected to the middle seat receiver and having a rear upper end movably connected to the middle backrest support slider and a front lower end movably connected to the middle front leg base; the middle rear leg being extended through the middle rear leg slider and having a front upper end movably connected to the middle rear leg holder, which is also movably connected to the middle front leg; the middle seat receiver post being connected at an upper end to the middle seat receiver pivot movably provided on the middle seat receiver, and being movably connected at a lower end to the middle post slider, which is movably fitted around the front lower end of the middle front leg; the middle leg connecting member having a front end movably connected to the middle front leg; a rear end of the middle leg connecting member and a lower end of the middle backrest support being pivotally connected to the middle slider, which is movably provided on the middle rear leg; the middle backrest support slider being movably fitted around the middle backrest support; and the middle rear limiter also being provided on the middle rear leg;

the first right front support and the second right front support being movably connected to one another in a crisscross pattern; the first right front support having an upper end movably connected to the right seat receiver pivot and a lower end movably connected to the middle front leg base; and the second right front support having an upper end movably connected to the middle seat receiver pivot and a lower end movably connected to the right front leg base;

the first right rear support and the second right rear support being movably connected to one another in a crisscross pattern; the first right rear support having an upper end movably connected to the right backrest support slider and a lower end movably connected to the middle slider; and the second right rear support having an upper end movably connected to the middle backrest support slider and a lower end movably connected to the right slider;

the first left front support and the second left front support being movably connected to one another in a crisscross pattern; the first left front support having an upper end movably connected to the left seat receiver pivot and a lower end movably connected to the middle front leg base; and the second left front support having an upper end movably connected to the middle seat receiver pivot and a lower end movably connected to the left front leg base;

the first left rear support and the second left rear support being movably connected to one another in a crisscross pattern; the first left rear support having an upper end movably connected to the left backrest support slider and a lower end movably connected to the middle slider; and the second left rear support having an upper end movably connected to the middle backrest support slider and a lower end movably connected to the left slider; and the seat being located among the right seat receiver, the left seat receiver and the middle seat receiver; and the backrest being located among the right backrest support, the left backrest support and the middle backrest support.

2. The folding chair according to claim 1, wherein the right seat receiver pivot includes a first pivot section, a first cradle section and a first sleeve section; the first cradle section being located on a top of the first pivot section, and the first sleeve section being located at one side of the first pivot section; the first right front support being movably connected at its upper end to the first pivot section, the right seat receiver being movably connected near its front end to the first cradle section, and the right armrest post being movably extended through the first sleeve section, which is downward abutted on the right front limiter provided on the right armrest post.

3. The folding chair according to claim 1, wherein the right rear leg slider includes a second sleeve section and a second pivot section located at one side of the first sleeve section; the right rear leg being movably extended through the second sleeve section; and the right seat receiver being movably connected at its rear end to the second pivot section.

4. The folding chair according to claim 1, wherein the right rear leg holder includes a third pivot section and a fourth pivot section located at one side of the third pivot section; the third pivot section being movably connected to a point of the right front leg between two ends thereof, and the fourth pivot section being movably connected to the front upper end of the right rear leg.

5. The folding chair according to claim 1, wherein the right backrest support slider includes a third sleeve section, a fifth pivot section located at one side of the third sleeve section, and a sixth pivot section located at another side of the third sleeve section; the right backrest support being movably extended through the third sleeve section; the fifth pivot section being movably connected to the rear upper end of the right front leg; and the sixth pivot section being movably connected to the upper end of the first right rear support.

6. The folding chair according to claim 1, wherein the right slider includes a fourth sleeve section, and a seventh and an eighth pivot section separately located at two opposite sides of the fourth sleeve section; the right rear leg being movably extended through the fourth sleeve section; the seventh pivot section being movably connected to the lower end of the right backrest support; and the eighth pivot section being movably connected to the rear end of the right leg connecting member.

7. The folding chair according to claim 1, wherein the left seat receiver pivot includes a ninth pivot section, a second cradle section and a fifth sleeve section; the second cradle section being located on a top of the ninth pivot section, and the fifth sleeve section being located at one side of the ninth pivot section; the first left front support being movably connected at its upper end to the ninth pivot section, the left seat receiver being movably connected near its front end to the second cradle section, and the left armrest post being movably extended through the fifth sleeve section, which is downward abutted on the left front limiter provided on the left armrest post.

8. The folding chair according to claim 1, wherein the left rear leg slider includes a sixth sleeve section and a tenth pivot section located at one side of the sixth sleeve section; the left rear leg being movably extended through the sixth sleeve section; and the left seat receiver being movably connected at its rear end to the tenth pivot section.

9. The folding chair according to claim 1, wherein the left rear leg holder includes an eleventh pivot section and a twelfth pivot section located at one side of the eleventh pivot section; the eleventh pivot section being movably connected to a point of the left front leg between two ends thereof; and the twelfth pivot section being movably connected to the front upper end of the left rear leg.

10. The folding chair according to claim 1, wherein the left backrest support slider includes a seventh sleeve section, a thirteenth pivot section located at one side of the seventh sleeve section, and a fourteenth pivot section located at another side of the seventh sleeve section; the left backrest support being movably extended through the seventh sleeve section; the thirteenth pivot section being movably connected to the rear upper end of the left front leg; and the fourteenth pivot section being movably connected to the upper end of the first left rear support.

11. The folding chair according to claim 1, wherein the left slider includes an eighth sleeve section, and a fifteenth and a sixteenth pivot section separately located at two opposite sides of the eighth sleeve section; the left rear leg being movably extended through the eighth sleeve section; the fifteenth pivot section being movably connected to the lower end of the left backrest support; and the sixteenth pivot section being movably connected to the rear end of the left leg connecting member.

12. The folding chair according to claim 1, wherein the middle seat receiver pivot includes a seventeenth pivot section, an eighteenth pivot section and a third cradle section; the seventeenth and the eighteenth pivot section being separately located at two sides of the third cradle section; the seventeenth pivot section being movably connected to the upper end of the second right front support; the eighteenth pivot section being movably connected to the upper end of the second left front support; and the middle seat receiver being movably connected near its front end to the third cradle section.

13. The folding chair according to claim 1, wherein the middle rear leg slider includes a ninth sleeve section and a nineteenth pivot section located at one side of the ninth sleeve section; the middle rear leg being movably extended through the ninth sleeve section; and the middle seat receiver being movably connected at its rear end to the nineteenth pivot section.

14. The folding chair according to claim 1, wherein the middle rear leg holder includes a twentieth pivot section and a twenty-first pivot section located at one side of the twentieth pivot section; the twentieth pivot section being movably connected to a point of the middle front leg between two ends thereof, and the twenty-first pivot section being movably connected to the upper end of the middle rear leg.

15. The folding chair according to claim 1, wherein the middle backrest support slider includes a tenth sleeve section, a twenty-second pivot section, a twenty-third pivot section and a twenty-fourth pivot section; the twenty-fourth pivot section being located at a front end of the tenth sleeve section, and the twenty-second section and the twenty-third section being separately located at two opposite sides of the tenth sleeve section; the middle backrest support being movably extended through the tenth sleeve section; the twenty-second pivot section being movably connected to the upper end of the second right rear support; the twenty-third pivot section being movably connected to the upper end of the second left rear support; and the twenty-fourth pivot section being movably connected to the rear upper end of the middle front leg.

16. The folding chair according to claim 1, wherein the middle slider includes an eleventh sleeve section, a twenty-fifth pivot section, a twenty-sixth pivot section, a twenty-seventh pivot section and a twenty-eighth pivot section; the twenty-fifth and the twenty-sixth pivot section being separately located at two opposite ends of the eleventh sleeve section; the twenty-seventh and the twenty-eighth pivot section being located at the same end of the eleventh sleeve section; the middle rear leg being movably extended through the eleventh sleeve section; the middle backrest support being movably connected at its lower end to the twenty-fifth pivot section; the middle leg connecting member being movably connected at its rear end to the twenty-sixth pivot section; the first right rear support being movably connected at its lower end to the twenty-seventh pivot section; and the first left rear support being movably connected at its lower end to the twenty-eighth pivot section.

17. The folding chair according to claim 1, further comprising a right link and a left link; the right link being movably connected at a rear end to the right seat receiver and being movably assembled at a front end to the right front limiter; and the left link being movably connected at a rear end to the left seat receiver and being movably assembled at a front end to the left front limiter.

18. The folding chair according to claim 1, further comprising a right rear leg base, a left rear leg base and a middle rear leg base; the right rear leg base being connected to a rear lower end of the right rear leg; the left rear leg base being connected to a rear lower end of the left rear leg; and the middle rear leg base being connected to a rear lower end of the middle rear leg.

19. The folding chair according to claim 1, wherein the backrest and the seat are connected to each other.

* * * * *